US006182905B1

(12) United States Patent
Dupre

(10) Patent No.: US 6,182,905 B1
(45) Date of Patent: Feb. 6, 2001

(54) APPARATUS AND METHOD FOR MAKING SNOW

(76) Inventor: Herman K. Dupre, c/o Seven Springs, Champion, PA (US) 15622

( * ) Notice: Under 35 U.S.C. 154(b), the term of this patent shall be extended for 0 days.

(21) Appl. No.: 09/596,336

(22) Filed: Jun. 19, 2000

(51) Int. Cl.[7] ..... F25C 3/04
(52) U.S. Cl. ..... 239/2.2; 239/14.2
(58) Field of Search ..... 239/2.2, 14.2, 239/419

(56) References Cited

U.S. PATENT DOCUMENTS

| | | | | |
|---|---|---|---|---|
| 3,964,682 | | 6/1976 | Tropeano et al. | 239/2.2 |
| 5,004,151 | | 4/1991 | Dupre | 239/2.2 |
| 5,810,251 | * | 9/1998 | McKinney | 239/2.2 |
| 5,823,427 | * | 10/1998 | Dupre et al. | 239/14.2 |
| 5,884,841 | * | 9/1998 | Ratnik et al. | 239/2.2 |
| 6,032,872 | | 3/2000 | Dupre | 239/14.2 |

* cited by examiner

*Primary Examiner*—Lesley D. Morris

(74) *Attorney, Agent, or Firm*—Carothers & Carothers

(57) ABSTRACT

A snow making tower is illustrated wherein an elongated tower conduit combination is provided which includes an elongated air conduit extending within the water conduit and air and first water discharge nozzles are respectively provided adjacent the upper ends of the air and water conduits and positioned for producing a plume of atomized water from external interacting air and water discharged under pressure from the air and first water discharge nozzles to produce snow in subfreezing ambient conditions. These first water discharge nozzles have a nozzle discharge passage in their sides which are positioned to direct a jet of water into air immediately discharged under pressure from the air discharge nozzles prior to the external main interacting of air and water which produces the plume. This provides preliminary atomization of water in the air discharged prior to its interaction for producing a more finely atomized plume. In another embodiment of the present invention illustrated, air and water are intermixed internally in the snow making tower at the upper end thereof and in order to prevent access of water downwardly into top end of the internal water conduit an inverted cup is positioned over the upper end of the internally terminating air conduit such that the inverted cup acts as a trap.

9 Claims, 3 Drawing Sheets

APPARATUS AND METHOD FOR MAKING SNOW

BACKGROUND OF THE INVENTION

This invention relates generally to the art of fluid sprinkling and more particularly to the manufacture of snow with elongated pipe-type snow making towers.

The present invention pertains to improvements over the inventor's inventions disclosed in U.S. Pat. Nos. 5,004,151 and 6,032,872. A suitable discussion giving a major portion of the prior art background of the present invention is presented in these patents and is accordingly incorporated herein by reference.

Generally, the former inventions for artificially producing snow as disclosed in these two patent references consist of a method and apparatus for making snow through the use of snow towers wherein water is supplied under pressure to a point of discharge above ground level and adjacent the top end of the tower where it is discharged through a first water nozzle into the ambient freezing atmosphere in the form of a spray. The spray is preferably a high velocity spray of discrete water particles, sometimes referred to as a fine water spray.

Air is supplied independently under pressure to a second point of discharge at the top of the snow tower and there discharged through an orifice to form a jet stream or a thin air stream which is directed into the aforesaid water spray thereby forming a plume of atomized or nucleated water. This atomized water forms seed crystals in the freezing atmosphere, and through the dwell time of the long fall from the top of the tower to the ground, forms snow.

The inventor has discovered that the finer that the water spray is nucleated or atomized in order to form this plume, the greater is the quality of the snow and the greater is the possibility of making snow in warmer subfreezing conditions, and one aspect of the present invention is directed to this end.

Another aspect of the present invention is directed toward the invention disclosed in the inventor's U.S. Pat. No. 6,032,872 wherein instead of externally mixing the air and water at the top of the tower, a portion of the air and water under pressure are internally mixed at the upper end of the tower before a discharge into the subfreezing atmosphere. This system has advantages as outlined in the aforementioned patent disclosure.

However, it has been discovered that if this latter mentioned system is utilized in a tilted or slanted position for the snow tower, as is usually the case, water tends to back down the terminal upper end of the air pipe at the top of the tower. It is another object of the present invention to eliminate this problem.

SUMMARY OF THE INVENTION

The snow making tower of the present invention includes an elongated tower conduit combination having an elongated air conduit extending with an elongated water conduit. The tower is provided with an appropriate ground support mount.

Air and first water discharge nozzles are provided respectively adjacent the upper ends of the air and water conduits and positioned for producing a plume of atomized water created by external interacting or mixing of air and water discharged under pressure from the air and first water discharge nozzles to produce snow in subfreezing ambient conditions. Couplings for connecting air and water under pressure respectively to the lower ends of the air and water conduits are provided.

The first water discharge nozzles have a nozzle discharge passage provided in their side which are positioned to direct a jet of water into air immediately discharged under pressure from the air discharge nozzles prior to external interacting of air and water for producing the plume as afore-described. This preliminarily provides atomized water in the air discharge prior to the aforedescribed interaction of air and water for producing a more finely atomized plume for thereby producing higher quality snow at higher subfreezing temperatures.

These first water nozzles may be provided in a detachable form to substitute nozzle size and additional second water nozzles may also be positioned on the water conduit for directing additional water spray into the afore-described plume or plumes.

In another aspect of the present invention, the snow making tower is provided with an elongated tower pipe mounted on a support with a first water discharge nozzle provided adjacent the upper end of the tower pipe and a water connection is provided at the lower end of the tower pipe for connection to a source of water under pressure for supply thereof through the tower pipe to the first water discharge nozzle for discharge into ambient atmosphere at subfreezing conditions. An air conduit coextends within this tower pipe with the bottom end thereof extending externally of the tower pipe for connection to a source of air under pressure for supply thereof to the top end. The top end of the air conduit terminates inside the tower pipe for ejecting air from the termination into the interior of the tower pipe adjacent the upper end thereof for internal mixing of air and water. An inverted cup is slidably positioned over the top end of the air conduit in order to serve as a trap for preventing water from flowing into the top end of said air conduit when the upper end of the air conduit is positioned upright but other than vertical.

The air conduit may terminate through a biased check valve which is biased to release air into the interior of the tower pipe between the inverted cup and the top end at a predetermined threshold pressure.

In order to properly operate the tower, a valve should be provided for regulating the pressure of water supplied to the tower so that the water pressure may be regulated in relationship to the supplied air pressure which exists internally at the upper end of the air conduit. A gate valve works best for this purpose.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF THE PREFERRED EMBODIMENTS

Figures 1, 2:
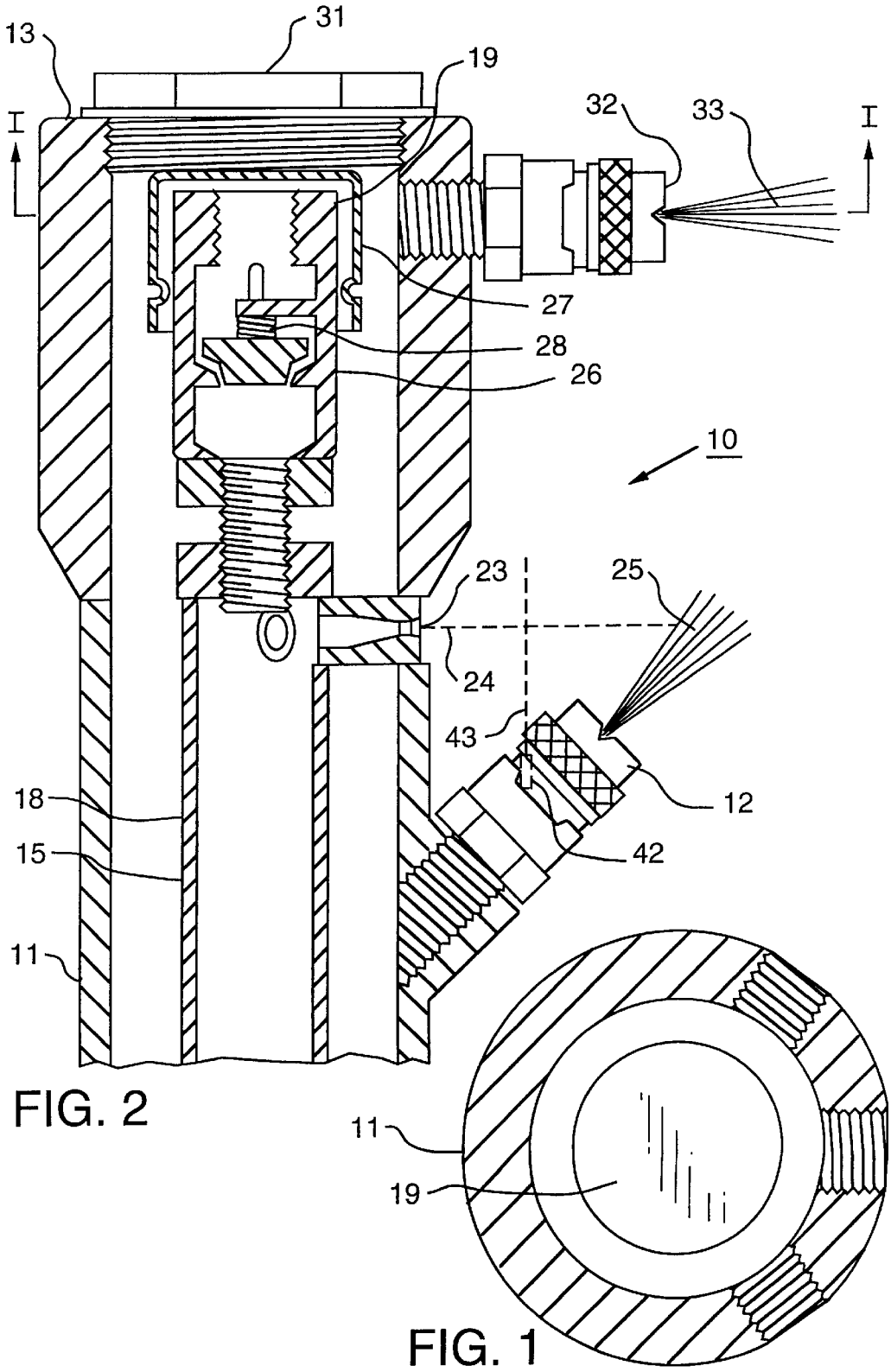
FIG. 1 is a top or plan view showing the upper end of the snow making tower of the present invention as seen in partial section along horizontal section line I—I of FIG. 2 with the nozzles removed.
FIG. 2 is a view in side elevation of the upper end of the snow making tower of the present invention shown in vertical mid cross section.
Figure 3:
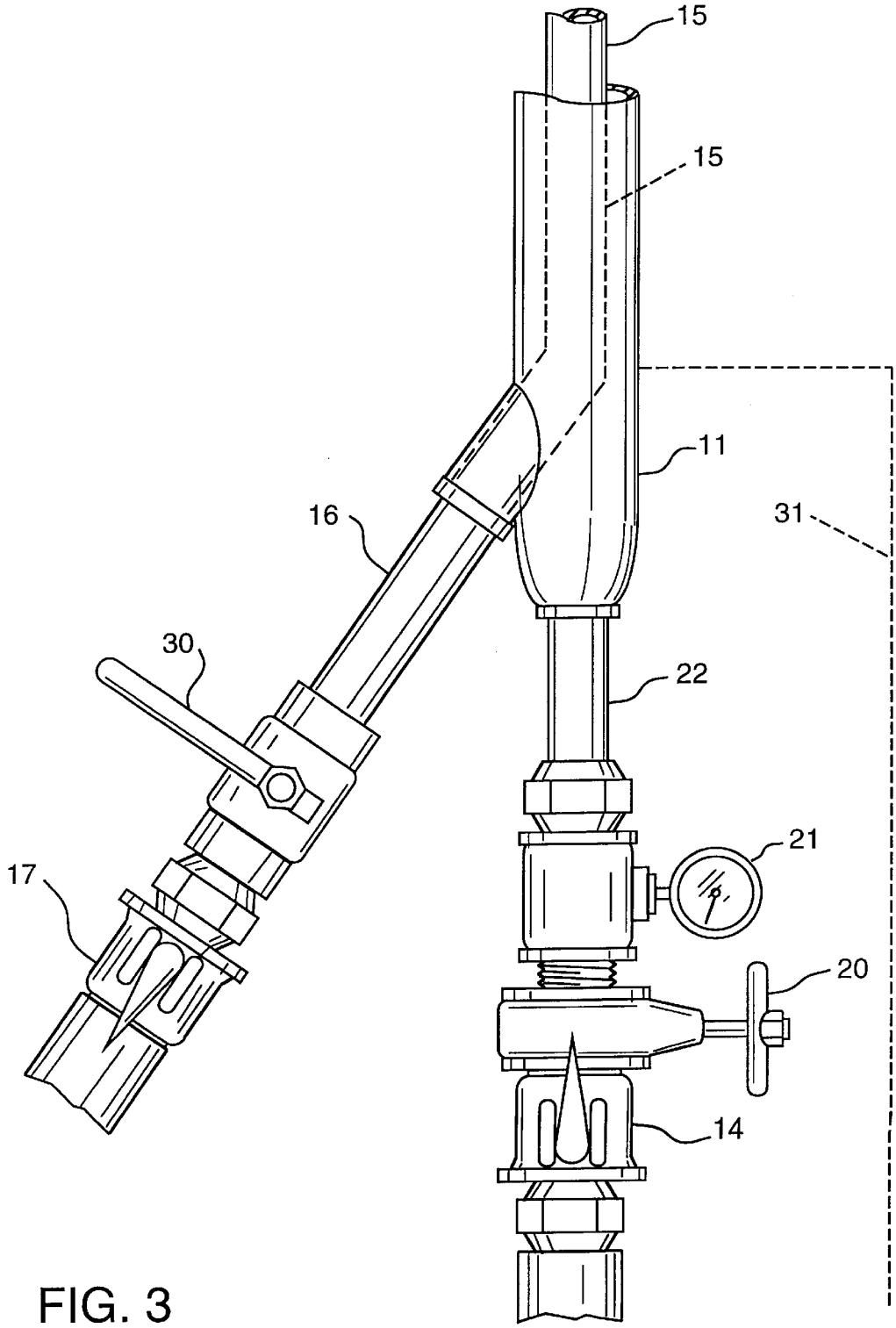
FIG. 3 is a view in side elevation showing the bottom or base portion of the snow making tower illustrated in FIG. 2.

Referring first to FIGS. 1, 2 and 3, the snow making tower 10 of the present invention includes an elongated tower pipe 11 mounted on a support. For purposes of clarity, the support 31 is shown only schematically and reference should be had to the aforementioned patents and others for many different types of ground support systems which are available to support the tower 10 in its upright position on a ski slope.

First water discharge nozzles 12 are provided adjacent the upper end 13 of tower pipe 11 and a water connection 14 is provided at the lower end of tower pipe 11 for connection to a source of water, usually remote, under pressure for supply thereof through the outer pipe 11 of the tower 10 to nozzles 12 for discharge into the ambient atmosphere in the form of a fine spray.

An air conduit 15 coextends within tower pipe 11 and the bottom end 16 thereof extends externally of tower pipe 11 for connection to a remote source of air under pressure at coupling 17 in order to supply air under pressure through coextending inner air conduit 15 to the upper end 18 thereof. The upper end 18 of air conduit 15 terminates inside tower pipe 11 at outlet 19 where the air is then intermixed with the water within outer tower pipe 11 after ejecting from under inverted cup 27, which serves as a trap, and then is ejected through nozzle 32 as an air/water mixture for manufacture of snow in subfreezing ambient conditions. Multiple nozzles 32 are provided, as indicated in FIG. 1, at substantially the same horizontal plane to obtain equal air/water spray mixes 33.

A gate valve 20 is connected to the water connection 14 for regulating pressure of water supplied to the tower pipe 11. In addition, a water pressure meter 21 is also connected between the valve 20 and the base of tower pipe 1 for indicating water pressure in tower pipe 11. As is taught in the inventor's prior art patents, the air conduit 15 for its full coextending length within pipe tower 11 is insulated by the water flowing within tower pipe 11 which acts as an insulating jacket and prevents freeze-up of moisture within air conduit 15.

With particular reference to FIG. 3, the water connection 14 via water pipe 22 exits the lower end of tower pipe 11 in direct line therewith and the air connection 17 exits tower pipe 11 via conduit 16 at the lower end thereof at right angles as illustrated. This feature permits the water under pressure to flow in direct line with the tower pipe. This supplies water under pressure to the tower pipe 11 with greater efficiency and less loss due to friction previously experienced in prior art pipe towers wherein the water is fed to the base of the tower through right angle connections. Air under pressure flowing through right angle connections as illustrated in FIG. 3 does not lose pressure through friction loss to the degree that water does when caused to go through right angle turns.

The top end 18 of air conduit 15 terminates also, and alternatively, to air nozzles 23 positioned adjacent the upper 13 of tower pipe 11 for ejecting a fine stream of air therefrom to ambient atmosphere under pressure into water spray 25 emanating from first water nozzles 12 in order to further atomize the water spray for the manufacture of better quality snow. While only one first water nozzle 12 is depicted in FIG. 2, in reality multiple such first water nozzles 12 and multiple such air nozzles 23 are provided as taught by the aforementioned prior art references.

The top end 18 of air conduit 15 also terminates internally of tower pipe 11 adjacent the upper end 13 through bias check valve 26 which is biased under spring pressure of compression spring 28 to release air under pressure at outlet 19 into the interior of the upper end of tower pipe 11 at a predetermined threshold pressure.

Because the air under pressure is delivered to the top of tower pipe 11, instead of to the bottom end thereof as taught by the prior art relating to internal mixing of air and water, the snow tower 10 can be run or operated at much greater efficiencies than the air/water internal mixing pipe towers of the prior art. For example, to operate the tower 10 illustrated, if water is delivered under pressures greater than 150 psi to connection 14 and air under pressure is delivered to connection 17 typically at 125 psi, 80 psi is a sufficient minimum to operate such a snow making tower. The ball valve 30 is first turned off to turn off the air and then gate valve 20 is closed down until gauge 21 indicates the water pressure at an appropriate pressure such as 40 psi. Then the air is turned back on via ball valve 30 and the tower 10 will operate to produce better quality snow than heretofore possible with prior art snow making towers which intermix the air and water internally. The increased efficiency in air delivered under pressure directly to the top 13 of tower 10 greatly increases the water/air pressure escaping nozzle 32 over the prior art towers making the tower 10 operate much more efficiently and causing it to manufacture better quality snow than heretofore possible internal mixing towers.

The check valve 26 prevents water from entering the air supply system in air conduit 15 to a limited extent and will not permit air under pressure to exit internally into the upper end of tower 10 at upper end or port 19 unless the air pressure at that point exceeds the water pressure. However, in reality the upper end 18 of the tower is generally, in actual use, not positioned exactly vertical as illustrated in the figure and is typically positioned upright but off vertical or at a slant. Thus, without inverted trap cup 27, water will tend to pour into one side of the upper terminating end 19 of air conduit 15. The air trap created by inverted cup 27 prevents this problem from occurring. Cup 27 is limited in its vertical or upright motion by top access cap 31.

Another embodiment of the present invention is also illustrated in FIG. 2 wherein each of the first water discharge nozzles 12 are provided in their side with a fine discharge passage 42 which are positioned as illustrated to direct a jet of water 43 into air immediately discharged under pressure as indicated in the form of air stream 24 immediately discharged under pressure from air discharge nozzle or nozzles 24 prior to the external mixing or interacting of air and water for producing a plume of atomized water when the air stream 24 strikes water spray 25. This preliminarily provides atomized water in the air discharge prior to the main interaction between the air stream 24 and the water spray 25 for ultimately producing a more finally atomized plume. This provides greater quality snow at higher subfreezing conditions. These water nozzles 12 with their passages 42 are detachable so that they may be replaced with nozzles of different sizes.

Figure 4:
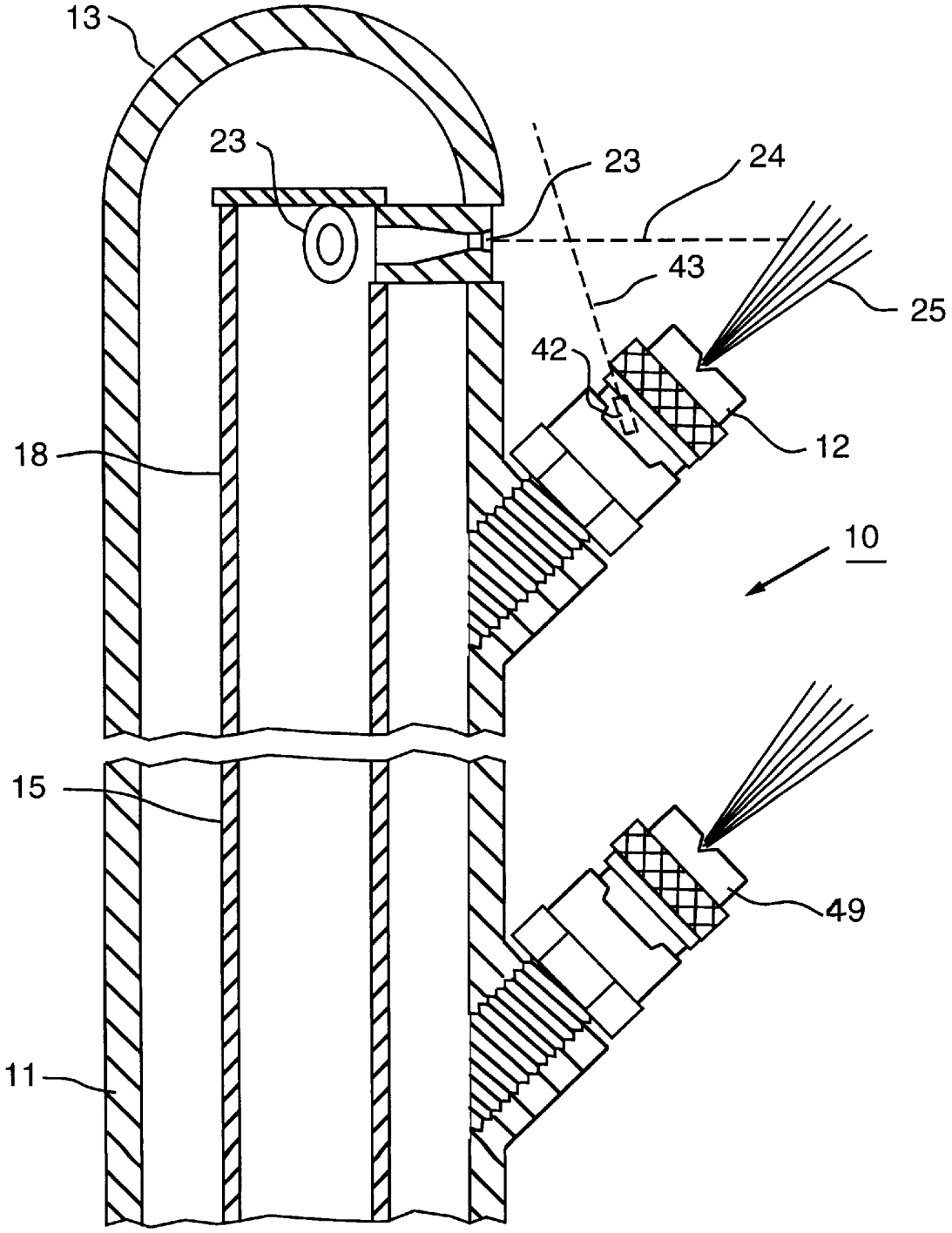
FIG. 4 is a view in side elevation of the upper end of the snow making tower of the present invention shown in vertical mid cross section illustrating another embodiment of the invention.

This latter feature is also illustrated in a different embodiment shown in FIG. 4 which further illustrates that second water nozzles 49 may also be positioned on the water conduit 11 for directing additional water spray into the plume created by the external interaction of the air stream 24 and water spray 25. This particular feature is of course previously illustrated in the inventor's afore-referenced U.S. Pat. No. 5,004,151.

The structure of FIG. 4 is in all respects identical to that shown in FIG. 2 with the exception that no internal mixing of air and water is accomplished or provided for. In all other respects the towers are identical and parts are therefore designated with the same reference numerals.

I claim:

1. A method of making snow comprising:

supplying water under pressure to a first point of discharge above ground;

discharging the supplied water through a first water nozzle into subfreezing ambient atmosphere in the form of a spray;

independently supplying air under pressure to a second point of discharge above ground;

discharging the supplied air under pressure into said sprayed water for thereby forming a plume of atomized water to produce snow; and preliminarily discharging a jet stream of water into air immediately discharged at said second point of discharge prior to forming said plume for preliminarily providing atomized water in said air discharge prior to discharge into said water spray for producing a more finely atomized plume.

2. A snow making tower comprising:

an elongated tower conduit combination including an elongated air conduit extending within an elongated water conduit and having, upper and lower ends and provided with a ground support mount;

air and first water discharge nozzles respectively provided adjacent the upper ends of said conduits and positioned for producing a plume of atomized water from external interacting air and water discharged under pressure from said air and first water discharge nozzles to produce snow in subfreezing ambient conditions;

couplings for connecting air and water under pressure respectively to the lower ends of said air and first water conduits;

said first water discharge nozzles having a nozzle discharge passage in their side which are positioned to direct a jet of water into air immediately discharged under pressure from said air discharge nozzles prior to said external interacting air and water producing said plume for preliminarily providing atomized water in said air discharge prior to said interaction for producing a more finely atomized plume.

3. The snow making tower of claim 2 wherein said first water discharge nozzles are detachable.

4. The snow making tower of claim 2 including second water nozzles positioned on said water conduit for directing additional water spray into said plume.

5. A snow making tower comprising:

an elongated tower pipe mounted on a support and having upper and lower ends with a first water discharge nozzle adjacent the upper end of said tower pipe and a water connection at the lower end of said tower pipe for connection to a source of water under pressure for supply thereof through said tower pipe to said first water discharge nozzle for discharge into ambient atmosphere;

an air conduit having top and bottom ends and coextending within said tower pipe with the bottom end thereof extending externally of said tower pipe for connection to a source of air under pressure for supply thereof to said top end;

said top end of said air conduit terminating inside said tower pipe for ejecting air from the termination into the interior of said tower pipe adjacent the upper end thereof; and an inverted cup slidably positioned over said top end of said air conduit for preventing water from flowing into the top end of said air conduit.

6. The snow making tower of claim 5, said top end of said air conduit terminating through a biased check valve which is biased to release air into the interior of said tower pipe from between said inverted cup and said top end at a predetermined threshold pressure.

7. The snow making tower of claim 6 including a valve connected to said water connection for regulating pressure of water supplied to said tower.

8. The snow making tower of claim 7 wherein said valve is a gate valve.

9. The snow making tower of claim 8 wherein the top end of said air conduit is positioned upright but off vertical.

* * * * *